US008012032B2

(12) United States Patent
Biancamano

(10) Patent No.: US 8,012,032 B2
(45) Date of Patent: Sep. 6, 2011

(54) PERSONAL DRIVING RANGE APPARATUS

(76) Inventor: Francesco Biancamano, Huntington Station, NY (US)

( * ) Notice: Subject to any disclaimer, the term of this patent is extended or adjusted under 35 U.S.C. 154(b) by 0 days.

(21) Appl. No.: 12/755,182

(22) Filed: Apr. 6, 2010

(65) Prior Publication Data

US 2010/0255920 A1 Oct. 7, 2010

Related U.S. Application Data

(60) Provisional application No. 61/166,845, filed on Apr. 6, 2009.

(51) Int. Cl.
*A63B 69/36* (2006.01)

(52) U.S. Cl. ..... 473/147; 473/139; 473/409

(58) Field of Classification Search ..... 473/139, 473/142–147, 150, 278, 409, 426, 429
See application file for complete search history.

(56) References Cited

U.S. PATENT DOCUMENTS

| | | | | | |
|---|---|---|---|---|---|
| 1,258,241 | A * | 3/1918 | Port | ..... | 473/139 |
| 3,550,937 | A * | 12/1970 | Patterson et al. | ..... | 473/428 |
| 3,754,761 | A * | 8/1973 | Pruss | ..... | 473/139 |
| 4,944,513 | A * | 7/1990 | Zentner | ..... | 473/428 |
| 5,286,028 | A * | 2/1994 | Daugard | ..... | 473/141 |
| 5,688,195 | A * | 11/1997 | Caso | ..... | 473/429 |
| 5,762,562 | A * | 6/1998 | Tiedge | ..... | 473/143 |
| 6,705,953 | B2 * | 3/2004 | Haskins | ..... | 473/278 |

* cited by examiner

*Primary Examiner* — Nini Legesse
(74) *Attorney, Agent, or Firm* — The Farrell Law Firm, P.C.

(57) ABSTRACT

A personal driving range apparatus is provided including a platform, a ball having at least one aperture that passes through the ball, at least one line having a first end and a second end. The first end is detachably connected to the platform, and the at least one line is drawn through the at least one aperture of the ball so that the ball is slidably disposed on the at least one line extending from the platform. The apparatus also includes a strap disposed at the second end of the at least one line for detachably securing the at least one line to a stationary object.

11 Claims, 3 Drawing Sheets

PERSONAL DRIVING RANGE APPARATUS

PRIORITY

This application claims priority under 35 U.S.C. §119(e) to a U.S. provisional application filed on Apr. 6, 2009, and assigned Ser. No. 61/166,845, the contents of which are incorporated herein by reference.

BACKGROUND OF THE INVENTION

1. Field of the Invention

The present invention relates to golf equipment, and more particularly, to an apparatus constructed to return a golf ball when practicing a golf swing.

2. Description of the Related Art

Typically when practicing a golf swing at a driving range, at least one golf ball is required for each swing of the club, and a great deal of room is required for the flight of the golf balls. These two requirements make the execution of a proper golf swing utilizing only a golf ball and a club nearly impossible in confined areas of personal property.

In order to practice a golf swing in a confined area, it would be beneficial for both the ball's flight to be restricted and for the ball to return to the area from which it was hit. Multiple innovations have been proposed that involve the use of lighter, modified golf balls. However, while these modified golf balls prevent the ball from traveling a great distance, the golfers swing may be affected due to the fact that a real golf ball is not being used. Additional innovations involve the use of a tether. When the golf ball is attached to the end of the tether, the tether restricts the flight of the ball and can also be utilized for ball retrieval. However, the tether must also be attached to a stationary object or the golfer, and the flight of the ball may be unpredictable and thereby dangerous to the golfer.

SUMMARY OF THE INVENTION

The present invention has been made to address at least the above problems and/or disadvantages and to provide at least the advantages described below. Accordingly, an aspect of the present invention provides a personal driving range apparatus and method of use.

According to one aspect of the present invention, a personal driving range apparatus is provided including a platform, a ball having at least one aperture that passes through the ball, at least one line having a first end and a second end. The first end is detachably connected to the platform, and the at least one line is drawn through the at least one aperture of the ball so that the ball is slidably disposed on the at least one line extending from the platform. The apparatus also includes a strap disposed at the second end of the at least one line for detachably securing the at least one line to a stationary object.

According to another aspect of the present invention, a method of using a personal driving range apparatus is provided. A strap is secured to a stationary object at a first distance above the ground. A platform is placed on the ground a second distance from the stationary object. At least one line that extends from the strap is attached to the platform. The at least one line extends through at least one aperture in a ball so that the ball is slidably disposed on the at least one line between the platform and the strap. When the ball is struck at the platform, it slides up the at least one line towards the strap then returns to the platform.

According to an additional aspect of the present invention, a personal driving range apparatus is provided. The apparatus includes a platform, a ball having an eye hook that extends outwardly from a surface of the ball, and at least one line having a first end and a second end. The first end is detachably connected to the platform, and the at least one line is drawn through the eye hook of the ball so that the ball is slidably disposed on the at least one line extending from the platform. The apparatus also includes a strap disposed at the second end of the at least one line for detachably securing the at least one line to a stationary object.

BRIEF DESCRIPTION OF THE DRAWINGS

Aspects, features and advantages of the present invention will become more apparent from the following detailed description when taken in conjunction with the accompanying drawings in which.

DETAILED DESCRIPTION OF EMBODIMENTS OF THE PRESENT INVENTION

Embodiments of the present invention are described in detail with reference to the accompanying drawings. Detailed descriptions of constructions or processes known in the art may be omitted to avoid obscuring the subject matter of the present invention.

Figure 1:
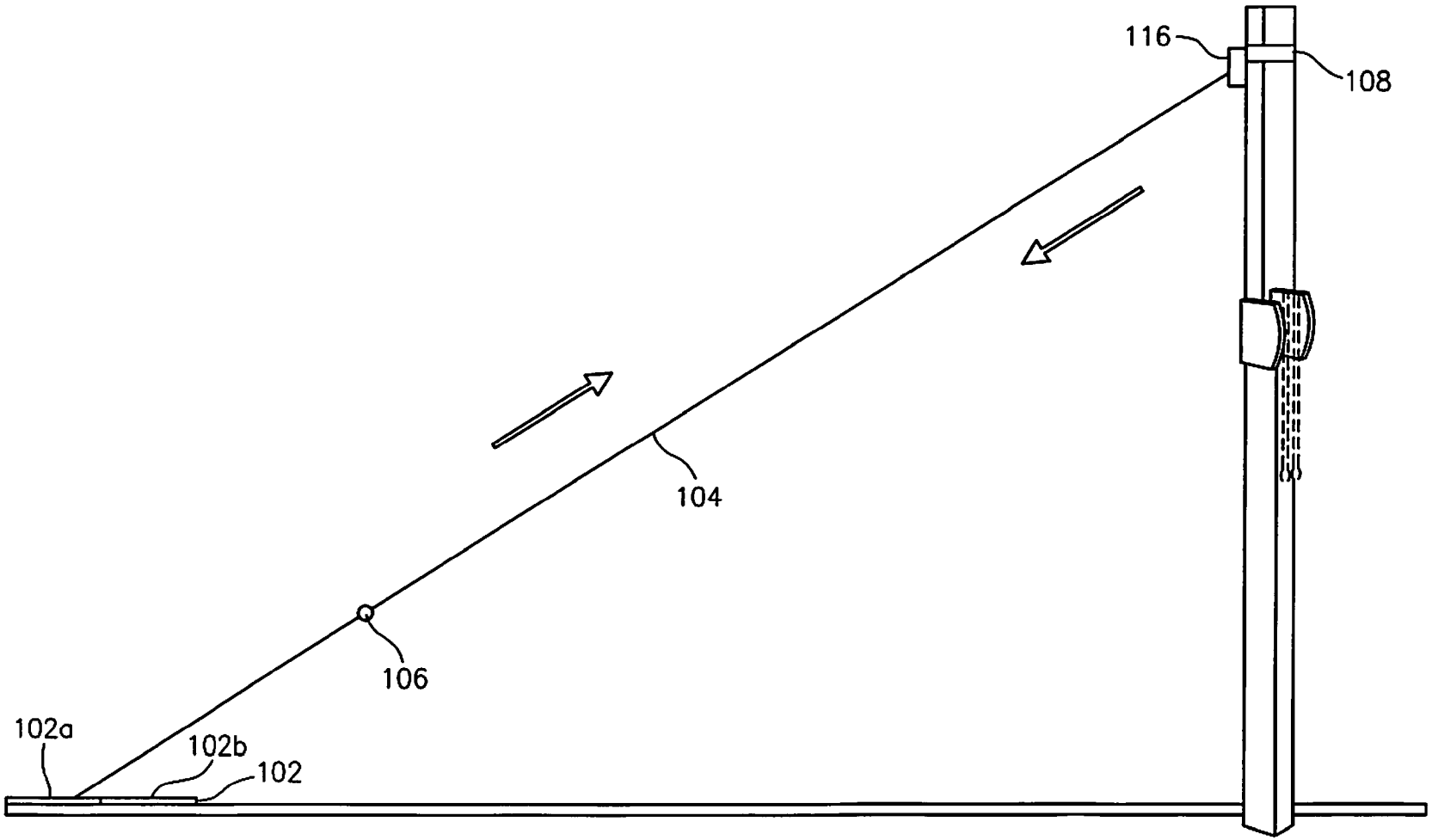
FIG. 1 is a diagram illustrating a side view of a personal driving range apparatus, according to an embodiment of the present invention.

Referring initially to FIG. 1, a diagram illustrates a side view of a personal driving range apparatus, according to an embodiment of the present invention. The apparatus includes a platform 102, a line 104, a ball 106, and a strap 108. The platform 102 is disposed on the ground and is preferably covered in a turf-like material to simulate grass. The platform 102 is constructed so that it is heavy enough to stay in place when the personal driving range apparatus is in use, and may be constructed of two or more foldable boards 102*a* and 102*b*. Alternatively, the platform 102 may be constructed of a pliable material capable of being rolled for storage. In an embodiment of the present invention, the platform 102 includes internal compartments 114 capable of being filled in order to provide additional weight to keep the platform 102 stationary during its use. For example, the compartments 114 may be filled with sand or water.

The ball 106 is a standard golf ball having a hole, or aperture, passing through its center. The line 104 is drawn through the hole, allowing the ball 106 to be slidably disposed on the line 104. In a preferred embodiment of the present invention, the ball 106 also includes a tubular sleeve fixed within the interior of the hole that allows the ball 106 to slide along the line 104 without significant damage to the ball 106. The tubular sleeve may be constructed of plastic or metal, and may incorporate the use of ball bearings within the ball to further reduce the resistance of the ball on the line.

The end of the line 104 is fitted with a detachable clamp 118 that is wider than the diameter of the hole in the ball 106. This detachable clamp 118 maintains the ball 106 on the line 104 when in place, and may be removed for ball or line adjustment or replacement purposes. The line 104 is preferably constructed of a high strength plastic that is capable of being cut. However, alternative embodiments of the line 104 may include a metallic wire or a rope.

The strap 108 includes a closure that allows it to be securely wrapped around an object. In a preferred embodiment of the present invention, the strap 108 is elastic and includes a VELCRO®-type closure. However, other securing mechanisms capable of achieving the same result may also be incorporated into the strap 108. In a preferred embodiment, the strap 108 includes a retracting mechanism that allows the line 104 to be extracted from and retracted to the area of the strap 108. The retracting mechanism may be disposed within the interior of the strap 108 or may be connected to an exterior of the strap 108. A further embodiment of the present invention includes a cushion 116 integrated into the strap 108 at an area from which the line 104 extends for extraction and retraction.

Figure 2:
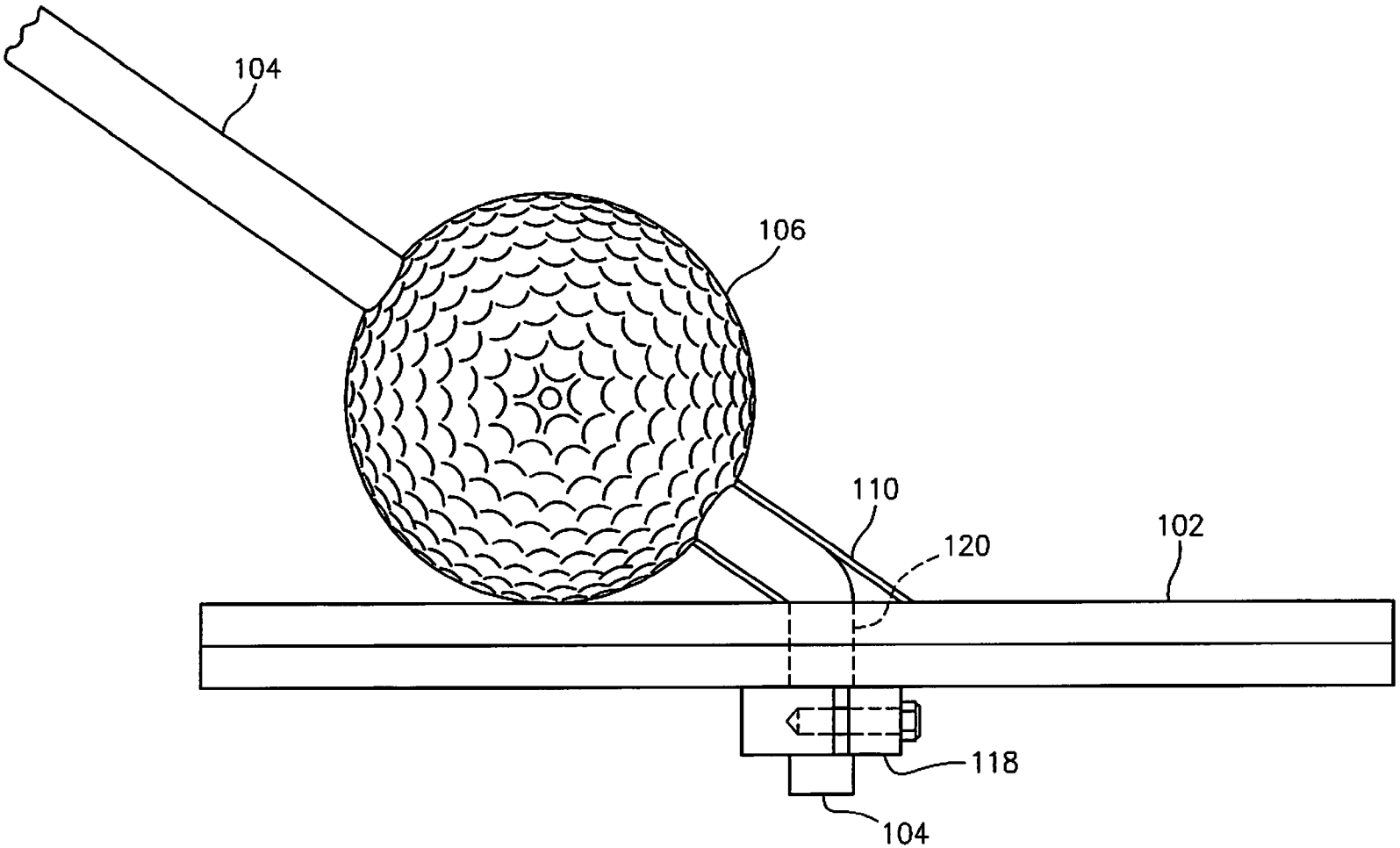
FIG. 2 is a diagram illustrating a golf ball disposed on a line of the personal driving range apparatus, according to an embodiment of the present invention.

When in use, the strap 108 is secured to a stationary object, preferably at a significant distance above and beyond the golfer, such as around a tree limb or a basketball hoop. The distance of the object from the golfer can vary due to the retracting mechanism, but should be a significant distance from the golfer, for example, 30 feet away. The platform 102 is opened and disposed on the ground in an area in which the golfer intends to practice. The ball 106 is pulled from the strap, extracting the line 104 from the retracting mechanism incorporated with the strap 108. The detachable clamp 118 at the end of the line 104 that maintains the ball 106 on the line 104 may be utilized to secure the line 104 through an aperture 120 in the platform 102. Specifically, the detachable clamp 118 may be removed and then reattached to the line 104, once the line 104 passes through the aperture 120 in the platform 102. The clamp 118 would therefore also have a width of greater diameter than the aperture 120 in the platform 102. This attachment results in an extension of the line 104 from the platform 102 to the strap 108 with the ball 106 sitting on top of the surface of the platform 102, as shown in FIG. 2.

When the golfer swings a club and strikes the ball 106 at the platform 102, the ball 106 travels up the line 104 and strikes the strap 108. In a preferred embodiment of the present invention, the ball 106 strikes the cushion integrated into the strap 108 to prevent damage to the stationary object to which the strap is secured. The platform 102 is kept in place due to its own weight, the weight of its filled compartments, and/or the weight of the user standing upon it. An additional protective sleeve 110 may be incorporated over the line 104 at its end near the clamp to prevent wear of the line 104 and damage to the club resulting from the striking club. However, should the line 104 become worn, additional line may be pulled from the retracting mechanism. The clamp is then detached, the worn line is cut, and the clamp is reattached.

After striking the strap 108, the ball 106 returns to its original position on the platform 102 due in part to the height of the strap 108 above the user. Thus, the apparatus provides for the automatic and predictable return of the ball 106 after absorbing a full swing with a club.

Figure 3:
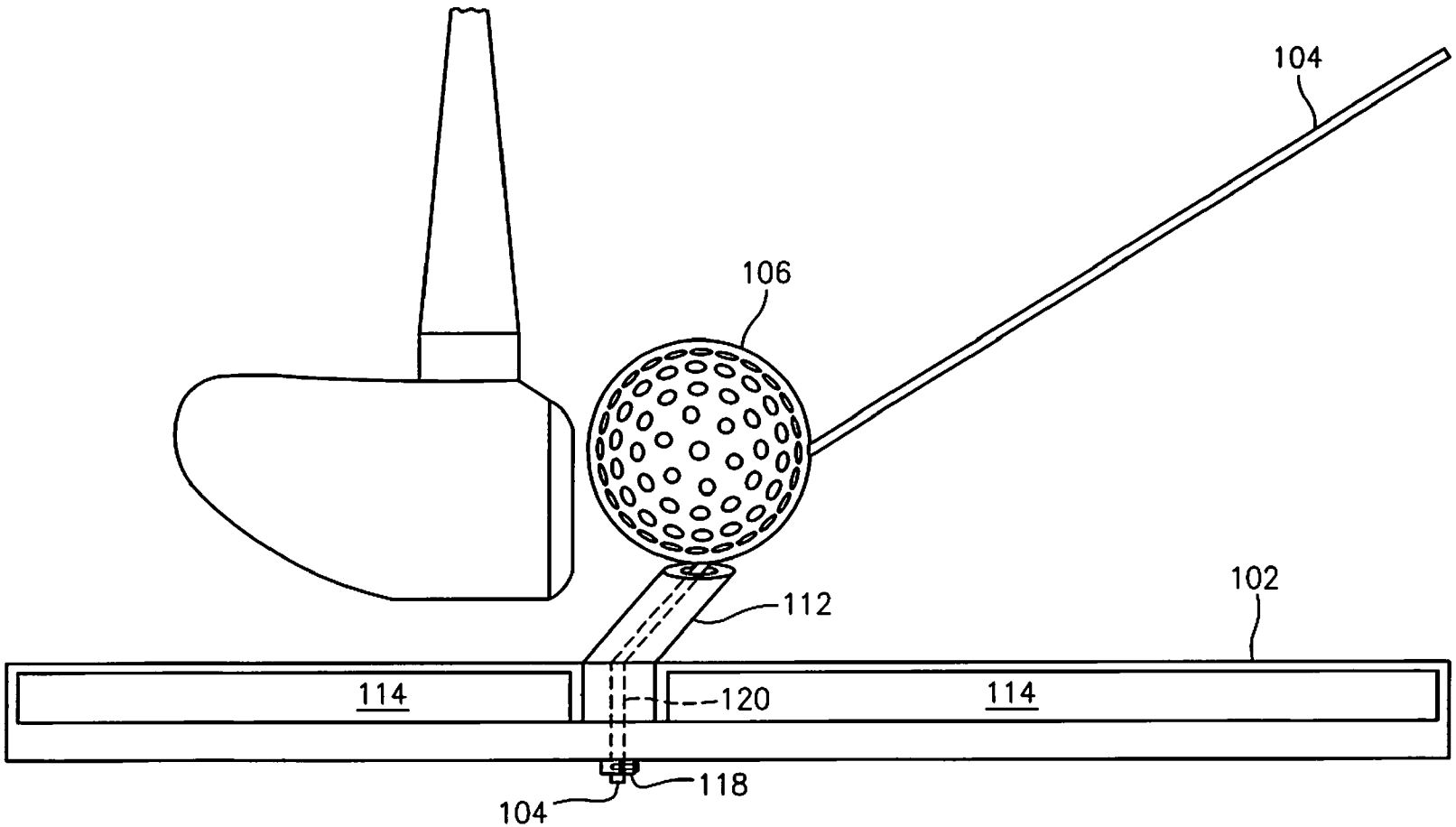
FIG. 3 is a diagram illustrating a golf ball disposed on an elevated tee of the personal driving range apparatus, according to an embodiment of the present invention.

An alternative embodiment of the present invention, as shown in FIG. 3, incorporates an elevated tee 112 over the aperture of the platform 102. The elevated tee 112 is provided with a hole that permits the line 104 to run through it for connection to the platform 102. The elevated tee 112 may project vertically from the platform 102. However, due to the tension created in the line 104 when the apparatus is set up for use, the elevated tee 112 preferably projects from the top surface of the platform 102 at an angle. A top surface of the elevated tee 112 has a horizontal surface that allows the ball 106 to rest upon the elevated tee 112. The elevated tee 112 may be removable to allow a golfer to practice a golf swing from the turf or from a tee. The elevated tee 112 may be constructed of a flexible plastic and protects both the line 104 and the golf club from damage.

Further, alternative embodiments of the present invention may incorporate the use of two or more lines through separate holes in the ball. For example, the use of two parallel lines that pass through a portion of the ball below its center allow the ball to be hit from the platform with minimal interference from the lines. The platform 102 would be adapted to provide a connective aperture for both lines, and the strap may be adapted to provide a single retracting mechanism capable of being used with both lines or with two separate retracting mechanisms.

In another alternative embodiment of the present invention, the aperture in the ball may be replaced with an eye hook that extends outwardly from the surface of the ball. The line is then threaded through the eye hook as opposed to the aperture and the apparatus may operate in the same manner as that described above.

Additional embodiments of the present invention may incorporate the use of electronic devices. Such electronic devices may be incorporated into the platform 102 and may be utilized to improve a golf swing. For example, the devices may measure or estimate the speed of the ball, the distance the ball would travel if unattached, or the speed of the club head.

While the invention has been shown and described with reference to a certain preferred embodiment thereof, it will be understood by those skilled in the art that various changes in form and details may be made therein without departing from the spirit and scope of the invention.

What is claimed is:

1. A personal driving range apparatus comprising:

a platform;

a ball having at least one aperture that passes through the ball;

at least one line having a first end and a second end, wherein the first end is detachably connected to the platform, and the at least one line is drawn through the at least one aperture of the ball so that the ball is slidably disposed on the at least one line extending from the platform; and a strap disposed at the second end of the at least one line for detachably securing the at least one line to a stationary object;

wherein the at least one line comprises a detachable clamp at the first end for connection to the platform; and wherein the at least one line extends through an aperture in the platform.

2. The personal driving range apparatus of claim 1, wherein the platform comprises two foldable boards.

3. The personal driving range apparatus of claim 1, wherein the platform comprises a pliable material capable of being rolled.

4. The personal driving range apparatus of claim 1, wherein the platform comprises internal compartments capable of being filled to provide additional weight for the platform.

5. The personal driving range apparatus of claim 1, wherein the strap is elastic.

6. The personal driving range apparatus of claim 1, wherein the strap comprises a cushion disposed in an area of the strap where the at least one line extends from the strap.

7. The personal driving range apparatus of claim 1, wherein the detachable clamp is disposed below the platform and is larger than the diameter of the at least one aperture of the ball and the aperture in the platform.

8. The personal driving range apparatus of claim 1, further comprising a flexible tee extending above the aperture in the platform, through which the at least one line extends, and upon which the ball rests.

9. The personal driving range apparatus of claim 8, wherein the flexible tee extends from the surface of the platform at angle in the direction of the at least one line, and wherein a top surface of the flexible tee is parallel with the platform.

10. The personal driving range apparatus of claim 1, further comprising a protective sleeve disposed around the at least one line and extending from the first end outward from the aperture in the platform.

11. A method of using a personal driving range apparatus comprising the steps of:

securing a strap to a stationary object at a first distance above the ground;

placing a platform on the ground a second distance from the stationary object; and attaching, to the platform, at least one line that extends from the strap, wherein the at least one line extends through at least one aperture in a ball so that the ball is slidably disposed on the at least one line between the platform and the strap;

wherein, when the ball is struck at the platform it slides up the at least one line towards the strap then returns to the platform;

wherein the at least one line comprises a detachable clamp at the first end for connection to the platform; and wherein the at least one line extends through an aperture in the platform.

* * * * *